US012607350B2

(12) United States Patent
Nieminen

(10) Patent No.: US 12,607,350 B2
(45) Date of Patent: Apr. 21, 2026

(54) FEEDER AND METHOD FOR FEEDING RAW MATERIAL COMPRISING PLASTIC

(71) Applicant: Teknologian Tutkimuskeskus VTT Oy, Espoo (FI)

(72) Inventor: Matti Nieminen, Espoo (FI)

(73) Assignee: TEKNOLOGIAN TUTKIMUSKESKUS VTT OY, Espoo (FI)

( * ) Notice: Subject to any disclaimer, the term of this patent is extended or adjusted under 35 U.S.C. 154(b) by 571 days.

(21) Appl. No.: 18/042,105

(22) PCT Filed: Aug. 11, 2021

(86) PCT No.: PCT/FI2021/050550
§ 371 (c)(1),
(2) Date: Feb. 17, 2023

(87) PCT Pub. No.: WO2022/038309
PCT Pub. Date: Feb. 24, 2022

(65) Prior Publication Data

US 2023/0313987 A1 Oct. 5, 2023

(30) Foreign Application Priority Data

Aug. 20, 2020 (FI) ..... 20205810

(51) Int. Cl.
*F23G 5/44* (2006.01)
*F23G 5/027* (2006.01)
(Continued)

(52) U.S. Cl.
CPC ..... *F23G 5/444* (2013.01); *F23G 5/027* (2013.01); *F23G 7/12* (2013.01); *F23K 3/02* (2013.01);
(Continued)

(58) Field of Classification Search
CPC ..... F23G 5/444; F23G 2205/121; F23G 2205/20; F23K 3/02; F23K 3/14
See application file for complete search history.

(56) References Cited

U.S. PATENT DOCUMENTS 4,019,783 A 4/1977 Kayser
4,413,935 A * 11/1983 Smith ..... F23K 3/02 251/324
(Continued)

FOREIGN PATENT DOCUMENTS

AT 396367 B 8/1993
CN 101484595 A 7/2009
(Continued)

OTHER PUBLICATIONS

Japanese Patent Office, Office Action Issued in Application No. 2023-512037, Jul. 8, 2025, 8 pages. (Submitted with Machine Translation).
(Continued)

*Primary Examiner* — David J Laux
(74) *Attorney, Agent, or Firm* — McCoy Russell LLP

(57) ABSTRACT

The invention relates to a feeder and method for feeding raw material which comprises plastic to a gasification, pyrolysis or combustion furnace, in which the feeder comprises a screw feeder part and a pneumatic feeder part in order to form a combined feeder for feeding the raw material, the screw feeder part comprises at least a screw to transfer the raw material to the pneumatic feeder part and at least one cooling device to cool the raw material in the screw feeder part, and the pneumatic feeder part arranged after the screw feeder part comprises at least one inlet to supply pneumatic carrier material to the raw material in the pneumatic feeder part for forming a mixture of the raw material and pneumatic carrier material.

13 Claims, 2 Drawing Sheets

(51) Int. Cl.

| | |
|---|---|
| ***F23G 7/12*** | (2006.01) |
| ***F23K 3/02*** | (2006.01) |
| ***F23K 3/14*** | (2006.01) |

(52) U.S. Cl.

CPC ..... *F23K 3/14* (2013.01); *F23G 2201/90* (2013.01); *F23G 2205/121* (2013.01); *F23G 2205/20* (2013.01)

(56) References Cited

U.S. PATENT DOCUMENTS

| | | | | |
|---|---|---|---|---|
| 4,423,688 | A | 1/1984 | Kuo | |
| 4,528,917 | A * | 7/1985 | Jacobs | F23K 3/02 110/259 |
| 5,724,901 | A | 3/1998 | Guy et al. | |
| 2012/0182827 | A1* | 7/2012 | Bairamijamal | C10J 3/30 366/151.1 |
| 2013/0291771 | A1* | 11/2013 | Lakhmiri | F23G 5/50 431/12 |
| 2016/0039118 | A1* | 2/2016 | Gehr | B09C 1/065 423/447.2 |
| 2018/0156453 | A1* | 6/2018 | Higgins | F23C 7/002 |

FOREIGN PATENT DOCUMENTS

| | | | |
|---|---|---|---|
| CN | 110274239 | A | 9/2019 |
| EP | 0474626 | A2 | 3/1992 |
| JP | S52114574 | U | 8/1977 |
| JP | H07103446 | A | 4/1995 |
| JP | H0814531 | A | 1/1996 |
| KR | 102059935 | B1 | 12/2019 |
| WO | 2010016513 | A1 | 2/2010 |
| WO | 2010090719 | A1 | 8/2010 |

OTHER PUBLICATIONS

State Intellectual Property Office of the People's Republic of China, Office Action and Search Report Issued in Application No. 202180051205.0, Apr. 9, 2025, 12 pages. (Submitted with Machine Translation).

Finnish Patent and Trademark Office, Search Report Issued in Application No. 20205810, Mar. 4, 2021, 2 pages.

ISA European Patent Office, International Search Report Issued in Application No. PCT/FI2021/050550, Dec. 1, 2021, WIPO, 5 pages.

Finnish Patent and Trademark Office, Office Action Issued in Application No. 20205810, Jun. 8, 2022, 6 pages.

* cited by examiner

FEEDER AND METHOD FOR FEEDING RAW MATERIAL COMPRISING PLASTIC

CROSS REFERENCE TO RELATED APPLICATIONS

The present application is a U.S. National Phase of International Application No. PCT/FI2021/050550 entitled "FEEDER AND METHOD FOR FEEDING RAW MATERIAL COMPRISING PLASTIC," and filed on Aug. 11, 2021. International Application No. PCT/FI2021/050550 claims priority to Finnish Patent Application No. 20205810 filed on Aug. 20, 2020. The entire contents of each of the above-listed applications are hereby incorporated by reference for all purposes.

FIELD

The application relates to a feeder defined in claim 1 and a method defined in claim for feeding raw material comprising plastic.

BACKGROUND

Known from the prior art is to treat plastic material by different processes to produce energy and/or product fractions.

Further, it is known from the prior art that plastic material is difficult to feed into the process. A screw feeder may be used to feed plastic material to a process. However, problem is that some components of the plastic material may melt in the screw and after that feeding becomes unstable. In addition, impurities of the plastic material may cause deposits around screw axes.

From EP 0474626 is known a method for continuous feeding, in which a mixture is fed by a conveyor comprising a screw at conveying temperature of 50-150° C., in particular 70-130° C., to a reactor. Water vapour and/or gas containing oxygen may be added to the mixture before the reactor for facilitating dividing of the mixture in the reactor and for increasing a conversion rate of the mixture in the reactor.

From U.S. Pat. No. 4,423,688 is known means for feeding particles having a meltable polymer constituent into a fluidized bed reactor. The means comprises a specialized feed tube with a brush-screw auger-type feeder, and a pressurized gas is arranged to flow from a source of pressurized gas, which is provided near particle source, through the tube of the feeder toward the reactor to agitate the particles therein and to prevent backflow of hot gases from the reactor.

OBJECTIVE

The objective is to disclose a new type feeder and method for feeding plastic containing material to a desired process in which high temperature is used. Further, the objective is to disclose a new combined feeder. Further, the objective is to disclose a practical feeder and method for feeding plastic containing material to a gasification and pyrolysis. Further, the objective is to disclose a practical feeder and method for feeding plastic containing material to a combustion furnace.

SUMMARY

The feeder and method are characterized by what are presented in the claims.

In the feeder and method, a combined feeder comprising a screw feeder part and a pneumatic feeder part is formed for feeding raw material which comprises plastic. The screw feeder part comprises at least a screw to transfer the raw material to the pneumatic feeder part, and the pneumatic feeder part arranged after the screw feeder part comprises at least one inlet to supply pneumatic carrier material to the raw material in the pneumatic feeder part.

BRIEF DESCRIPTION OF THE DRAWINGS

The accompanying drawings, which are included to provide a further understanding of the invention and constitute a part of this specification, illustrate some embodiments of the invention and together with the description help to explain the principles of the invention. In the drawings.

DETAILED DESCRIPTION

Figure 1:
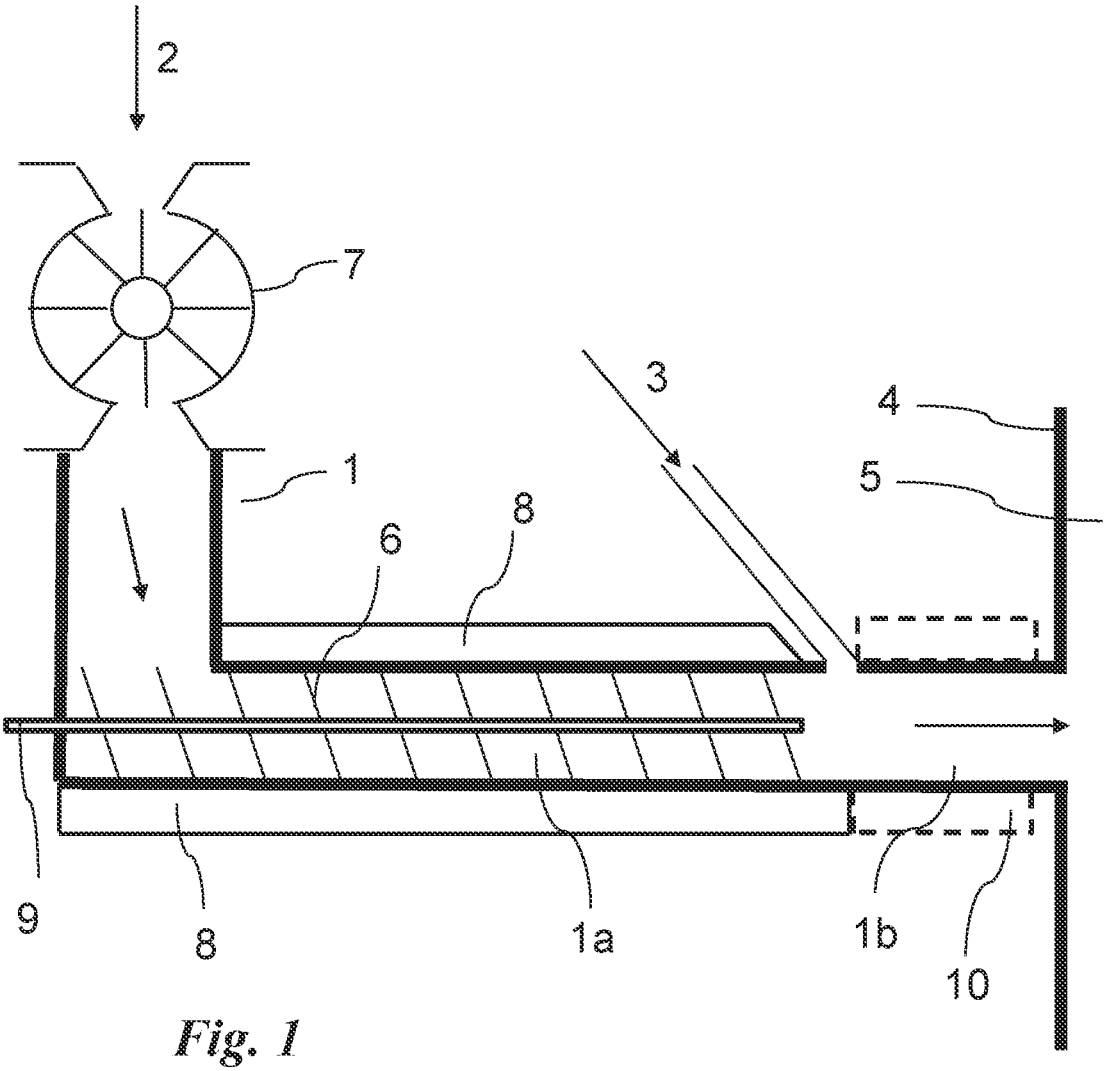
FIG. 1 shows a feeder for feeding plastic containing raw material according to one embodiment.

The feeder (1) for feeding raw material (2) which comprises plastic to a gasification, pyrolysis or combustion furnace, such as to a process in which high temperatures are used, comprises a screw feeder part (1*a*) and a pneumatic feeder part (1*b*) in order to form a combined feeder for feeding the raw material which is in a solid form and which comprises plastic. The screw feeder part is followed by the pneumatic feeder part. The screw feeder part comprises at least a screw (6) to transfer the raw material to the pneumatic feeder part and at least one cooling device (8,9) to cool the raw material in the screw feeder part, i.e. to prevent temperature increase to over melting temperature in the raw material. The pneumatic feeder part arranged after the screw feeder part comprises at least one inlet to supply pneumatic carrier material (3) which is steam to the raw material in the pneumatic feeder part for forming a mixture of the raw material and pneumatic carrier material.

In the method for feeding raw material which comprises plastic to a gasification, pyrolysis or combustion furnace, the raw material which is in a solid form and which comprises plastic is subjected into a feeder which comprises a screw feeder part and a pneumatic feeder part, the raw material is transferred by means of the screw feeder part which comprises at least a screw to the pneumatic feeder part arranged after the screw feeder part, pneumatic carrier material which is steam is supplied to the raw material via at least one inlet in the pneumatic feeder part for forming a mixture of the raw material and pneumatic carrier material, and the mixture is fed to a gasifier, pyrolysis reactor or combustor.

One embodiment of the feeder is shown in FIG. 1.

Figure 2:
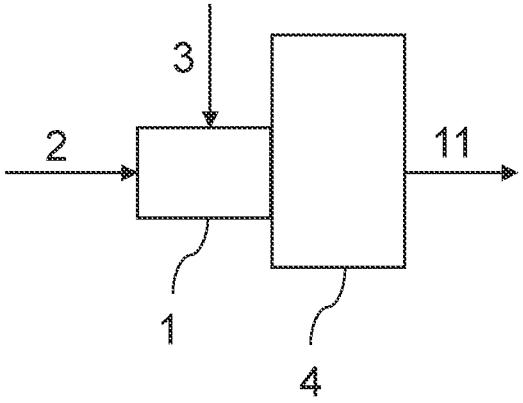
FIG. 2 is a flow chart illustration of a process according to one embodiment.

One embodiment of the process arrangement is shown in FIG. 2.

In one embodiment, the raw material (2) is fed by means of the feeder to a gasification, pyrolysis or combustion furnace. In one embodiment, the raw material is fed by means of the feeder to the gasification or pyrolysis.

In this context, the raw material (2) means any material, which comprises at least plastic and/or polymer, i.e. the raw material means plastic containing raw material. The plastic containing raw material may consists of one or more raw material components. The plastic containing raw material may comprise waste or waste material. Further, the plastic containing raw material may comprise waste material and other material, e.g. any plastic material, recycled material, recovered fuel material or the like. In one embodiment, the plastic containing raw material comprises at least plastic containing waste, e.g. plastic waste. In one embodiment, the plastic containing raw material consists of the plastic containing waste. The plastic containing waste means any waste which comprises at least plastic and/or polymer. In one embodiment, the plastic containing raw material may comprise plastic material and at least one of recycled material, recovered fuel material or the like. Often the plastic containing raw material is a heterogenous material. In one embodiment, the plastic containing raw material comprises at least polyolefins, e.g. polyethylene and/or polypropylene. The plastic containing raw material may contain also other polymers. Further, the plastic containing raw material may contain also other components, such as paper, cardboard and/or aluminium material, e.g. aluminium foil. In one embodiment, the plastic containing raw material is a mixed raw material. In one embodiment, the plastic containing raw material comprises polyethylene, polypropylene, PVC, other plastics, other components and/or impurities. In one embodiment, the plastic containing raw material is a heterogenous material comprising at least polyolefins, and further PVC, other plastics, other components and/or impurities. In one embodiment, the plastic containing raw material is a heterogenous material comprising PVC. In one embodiment, the plastic containing raw material is in a solid form, e.g. in the form of shredded material. In one embodiment, the plastic containing raw material is treated before the supply into the feeder, for example by means of grinding, milling, chopping, shredding, or the like. In one embodiment, the plastic containing raw material is crushed and/or ground. In one embodiment, particle sizes of the plastic containing raw material can vary, for example between 0.1 mm-100 mm in flat form particles and for example 0.1 mm-50 mm in spherical type particles. In one embodiment, the plastic containing waste is a fluffy plastic waste. In one embodiment, particle sizes of the fluffy plastic waste can vary, for example sizes of the fluffy particles may be below 50 mm×below 50 mm.

In this context, the pneumatic carrier material (3) means any suitable material which can be used in the pneumatic carrier material when the plastic containing raw material is fed to a desired gasification, pyrolysis or combustion furnace. Preferably the pneumatic carrier material is supplied to the pneumatic feeder part such that the supply is performed essentially after the screw of the screw feeder part, i.e. the screw ends before the supply of the pneumatic carrier material.

The pneumatic carrier material (3) is steam. Then the pneumatic feeder part arranged after the screw feeder part comprises at least one steam inlet to supply the steam to the plastic containing raw material in the pneumatic feeder part for forming a mixture of the plastic containing raw material and steam. In one embodiment, the steam comprises a water vapour. Further, the steam may contain also other components. In one embodiment, the steam is a saturated water vapour. In one embodiment, pressure of the steam is 1-5 bar, in one embodiment 2-5 bar, when pressure of the process, e.g. gasification or pyrolysis, is close to atmospheric pressure. In one embodiment, the steam comprises the water vapour, and temperature of the steam is 130-190° C. In one embodiment, temperature of the steam is 130-190° C., in one embodiment 140-185° C. and in one embodiment 150-180° C., when the steam is supplied to the pneumatic feeder part. In one embodiment, temperature of the steam is 130-190° C., in one embodiment 140-185° C. and in one embodiment 150-180° C., when the steam with pressure of 1-5 bar is supplied to the pneumatic feeder part. In one embodiment, pressure of the steam is 1-5 bar higher than pressure in the process, such as in the gasifier, pyrolysis reactor or combustor, to which the steam is supplied. In one embodiment, pressure in the process, such as in the gasifier, pyrolysis reactor or combustor, is close to atmospheric pressure, and pressure of the steam is 2-5 bar, in one embodiment 1-5 bar bar, higher than pressure in the process.

In one embodiment, the pneumatic carrier material (3) comprises oxygen containing gas. The oxygen containing gas comprises at least oxygen. Further, the oxygen containing gas may contain also other components. Then the pneumatic feeder part arranged after the screw feeder part comprises at least one gas inlet to supply the oxygen containing gas to the plastic containing raw material in the pneumatic feeder part for forming a mixture of the plastic containing raw material and the pneumatic carrier material comprising oxygen containing gas. In one embodiment, the oxygen containing gas is at room temperature, when the oxygen containing gas is supplied to the pneumatic feeder part. In one embodiment, temperature of the oxygen containing gas is below 40° C., in one embodiment below 30° C.

In one embodiment, the pneumatic carrier material (3) comprises methane.

In one embodiment, temperature is 10-100° C., preferably below 90° C., in one embodiment below 80° C., in one embodiment below 70° C., in one embodiment below 50° C. and in one embodiment about room temperature, in the screw feeder part (1*a*), when the plastic containing raw material (2) is fed by means of the feeder. In one embodiment, temperature is below 60° C., in one embodiment below 50° C. in the screw feeder part. It is important that plastic and polymer components in the plastic containing raw material does not melt in the screw feeder part. In one embodiment, some components of the plastic containing raw material may soften, but not melt in the screw feeder part.

In one embodiment, temperature is below 160° C., in one embodiment 120-160° C. and in one embodiment 135-155° C., in the pneumatic feeder part (1*b*), when the plastic containing raw material (2) is fed by means of the feeder and the steam is used as the pneumatic carrier material (3). Preferably, process conditions are arranged such that plastic and polymer components in the plastic containing raw material does not melt in the pneumatic feeder part. In one embodiment, some components of the plastic containing raw material may slightly melt, but the plastic containing raw material is not melted as a whole. In one embodiment, temperature is below 90° C., in one embodiment below 70° C., in one embodiment below 60° C. and in one embodiment below 50° C., in the pneumatic feeder part, when the plastic containing raw material is fed by means of the feeder, and especially if the oxygen containing gas is used as the pneumatic carrier material.

In this context, the mixture means any mixture from the raw material (2) and the pneumatic carrier material (3). The ratio of the plastic containing raw material and the pneumatic carrier material may vary. Preferably, the ratio of the plastic containing raw material and the pneumatic carrier material and/or an amount of the pneumatic carrier material, e.g. steam, may be selected based on a feed velocity of the plastic containing raw material, a configuration of the reactor, e.g. a gasifier, pyrolysis reactor or combustor, fluidization parameters in the reactor, an amount of fluidization gas and/or feed velocity of the fluidization gas. In one embodiment, an amount of the steam is selected in the mixture such that the amount of the steam is below 30 vol-% of fluidization gas in the reactor, e.g. in the gasifier or pyrolysis reactor.

In one embodiment, the feeder (1) comprises at least one gas lock provided with at least one equipment, e.g. provided with at least one rotary valve (7), gas tight rotating valve or other suitable equipment, to prevent steam flow in the opposite direction. In one embodiment, the feeder comprises more than one gas lock. The gas lock may be any gas lock, gas trap, gas seal or the like.

In one embodiment, the screw feeder part (1*b*) comprises at least one cooling device (8,9) to keep temperature in the screw feeder part below melting temperature of the plastic containing raw material (2). In one embodiment, the screw feeder part comprises at least one outer water jacket (8) as the cooling device. In one embodiment, the screw feeder part comprises at least one cooled screw (9), e.g. water cooled axis of the screw, as the cooling device. In one embodiment, the plastic containing raw material (2) is cooled in the screw feeder part (1*a*) to keep temperature below melting temperature of the plastic containing raw material.

In one embodiment, the pneumatic feeder part (1*b*) comprises at least one pneumatic carrier material feeding device, e.g. steam feeding device. In one embodiment, the pneumatic feeder part comprises more than one inlet for supplying the pneumatic carrier material, e.g. steam or oxygen containing gas, into the pneumatic feeder part. In one embodiment, the pneumatic feeder part comprises a steam feeding system, in which temperature of the steam is 130-190° C., in one embodiment 140-180° C. In one embodiment, the pneumatic carrier material, e.g. steam or oxygen containing gas, is supplied via more than one inlet into the pneumatic feeder part. In one embodiment, the pneumatic feeder part comprises at least one additional cooling device (10) for cooling the plastic containing raw material in the pneumatic feeder part. In one embodiment, the pneumatic feeder part comprises at least one cooling water jacket for cooling the plastic containing raw material in the pneumatic feeder part. In one embodiment, the plastic containing raw material is cooled in the pneumatic feeder part to keep temperature below melting temperature of the plastic containing raw material. In one embodiment, the length of the pneumatic feeder part (1*b*) is 0.5-1 m. Preferably, the screw (6) of the screw feeder part (1*a*) ends before the supply of the pneumatic carrier material (3), such as the inlet of the pneumatic carrier material, or before the pneumatic feeder part (1*b*). In one embodiment, the end of the screw is arranged before the pneumatic feeder part, e.g. 0.5-1.0 m from a wall of the gasifier, pyrolysis reactor or combustor.

Preferably, the pneumatic carrier material (3) acts as a pneumatic gas, and the plastic containing raw material (2) is fed pneumatically from the pneumatic feeder part to the gasifier, pyrolysis reactor or combustor, e.g. into a bed, such as into a fluidized bed. In one embodiment, the steam acts as a pneumatic gas, and the plastic containing raw material is fed pneumatically with the steam. In one embodiment, the pneumatic carrier material, such as the steam, conveys the plastic containing raw material into a bed of the gasifier, pyrolysis reactor or combustor. In one embodiment, the steam conveys the plastic containing raw material into a fluidized bed of the bubbling fluidized bed gasifier. In one embodiment, the steam conveys the plastic containing raw material into a fluidized bed of the circulating fluidized bed gasifier. In one embodiment, the steam conveys the plastic containing raw material into a fluidized bed of the fluidized bed pyrolysis reactor. In one embodiment, the feeder is arranged to feed the plastic containing raw material, i.e. the mixture of the plastic containing raw material and pneumatic carrier material, from the pneumatic feeder part into a bed of the gasifier, pyrolysis reactor or combustor.

In one embodiment, the feeder (1) is integrated with the gasifier (4), pyrolysis reactor or combustor. In one embodiment, the feeder is integrated with the gasifier or pyrolysis reactor, preferably without any gap between the feeder and the gasifier or pyrolysis reactor, and the feeder is arranged to feed the plastic containing raw material (2) to the gasifier or pyrolysis reactor. In one embodiment, the plastic containing raw material is fed to the gasifier or pyrolysis reactor such that the steam conveys the plastic containing raw material into a fluidized bed of the gasifier or pyrolysis reactor. In one embodiment, the plastic containing raw material is fed into a bed material of the gasifier or pyrolysis reactor.

In one embodiment, a process arrangement comprises at least one feeder and at least one gasifier, pyrolysis reactor or combustor. In one embodiment, the process arrangement comprises at least one feeder and at least one gasifier. In one embodiment, the process arrangement comprises at least one feeder and at least one pyrolysis reactor. In one embodiment, the process arrangement comprises at least one feeder and at least one combustor. In one embodiment, the process arrangement comprises more than one feeders. In one embodiment, the process arrangement comprises at least two feeders, e.g. two or more feeders or parallel feeders, for feeding the plastic containing raw material in at least two feed points or via at least two feed inlets to the reactor, such as the gasifier, pyrolysis reactor or combustor. In one embodiment, the process arrangement comprises at least one feed inlet for supplying the plastic containing raw material to the gasifier, pyrolysis reactor or combustor. The feed inlet may be any suitable inlet known per se, e.g. pipe, port or the like.

In this context, the gasification in a gasifier means any gasification process. In one embodiment, the gasification is carried out by steam. In this context, the gasification is a process that converts the plastic containing raw material into gasification products, e.g. hydrocarbons such as olefins. This is achieved by treating the raw material at suitable temperatures, and preferably with a controlled amount of steam.

In one embodiment, the gasification comprises at least one gasifier. In one embodiment, temperature is over 650° C., in one embodiment over 700° C., e.g. between 700-750° C., in the gasifier. In one embodiment, the treatment is carried out under predetermined pressure, e.g. under atmospheric pressure, in the gasifier. In one embodiment, the gasifier is a fluidized bed gasifier. In one embodiment, the gasifier is a bubbling fluidized bed gasifier. In one embodiment, the gasifier is a circulating fluidized bed gasifier. Any suitable bed material can be used as the fluiding material in the fluidized bed. In one embodiment, the gasification is a steam blown gasification of the plastic containing raw material.

In this context, pyrolysis in a pyrolysis reactor means any pyrolysis process. In one embodiment, the pyrolysis is carried out by steam. In this context, the pyrolysis is a process that converts the plastic containing raw material into pyrolysis products. This is achieved by treating the raw material at suitable temperatures.

In one embodiment, the pyrolysis comprises at least one pyrolysis reactor. In one embodiment, temperature is over 400° C., for example 400-700° C., in one embodiment 500-650° C., in the pyrolysis. In one embodiment, the treatment is carried out under predetermined pressure, e.g. under atmospheric pressure, in the pyrolysis reactor. In one embodiment, the pyrolysis reactor is a fluidized bed reactor. Any suitable bed material can be used as the fluiding material in the fluidized bed.

The feeder, process arrangement and method may be operated as a continuous process.

In one embodiment, the feeder is used and utilized in a production of hydrocarbons such as light hydrocarbons, olefins, e.g. ethylene, propylene and butadiene, other hydrocarbons, e.g. benzene and toluene, or other compounds, or their combinations, from the plastic containing raw material. The products, such as hydrocarbon fractions, can be used as such or can be supplied, for example, to a polymerization process, oxidation process, halogenation process, alkylation process or other chemical process, or to a production of plastic. For example, ethylene and propylene are building blocks for plastic products, petrochemical products and chemicals.

Thanks to the invention the plastic containing raw material can be fed easily and effectively to the desired apparatus or process, and thus, the plastic containing raw material can be utilized easily and effectively. The feeder and method offer a possibility to feed the plastic containing raw material easily, and energy- and cost-effectively. When the screw feeder part and the pneumatic feeder part is combined to form the combined feeder, a screw does not heat up from the effect of the process device, such as the gasifier, pyrolysis reactor or combustor, and contact between the hot screw and the plastic containing material can be avoided. Further, in the process of the invention the plastic containing raw material may be fed to the process device without pelletizing the material. Alternatively, pelletized material may be fed to the process device by means of the present feeder.

The present invention provides an industrially applicable, simple and affordable way to feed the plastic containing raw material. The feeder and method are easy and simple to realize in connection with production processes.

Further, the recycling of the plastic containing waste can be improved by means of the invention.

EXAMPLES

FIGS. 1 and 2 present the feeder and process arrangement for feeding and producing hydrocarbons continuously from plastic containing waste.

The feeder (1) is integrated with a gasifier (4), without any gap between the feeder and the gasifier, and the feeder is arranged to feed the plastic containing waste as the plastic containing raw material (2) to the gasifier (4).

The feeder (1) of FIG. 1 comprises a screw feeder part (1*a*) and a pneumatic feeder part (1*b*) in order to form a combined feeder. The screw feeder part (1*a*) is followed by the pneumatic feeder part (1*b*). The screw feeder part comprises at least a screw (6) to transfer the plastic containing waste (2) to the pneumatic feeder part (1*b*) and outer water jackets (8) and cooled screw (9), e.g. water cooled axis of the screw, as cooling devices to cool the plastic containing waste in the screw feeder part. The pneumatic feeder part arranged after the screw feeder part comprises at least one inlet to supply steam as the pneumatic carrier material (3) to the plastic containing waste in the pneumatic feeder part (1*b*) for forming a mixture of the plastic containing waste and steam.

The feeder (1) comprises at least one gas lock provided with at least one rotary valve (7). Before the screw feeder part (la) plastic containing waste (2) is going through rotary valve (7) or two rotary valves in order to form the gas lock for disabling the steam (3) flow to a screw direction.

Temperature of the steam (3) is 130-190° C., for example 150-180° C., when the steam is supplied to the pneumatic feeder part (1*b*). In the screw feeder part (1*a*), temperature is preferably below 60° C. or below 50° C., when the plastic containing raw material (2) is fed by means of the feeder. It is important that plastic and polymer components in the plastic containing raw material does not melt in the screw feeder part. In the pneumatic feeder part (1*b*), temperature may be 135-155° C., when the plastic containing raw material (2) is fed by means of the feeder and the steam is used as the pneumatic carrier material (3). Preferably, process conditions are arranged such that plastic and polymer components in the plastic containing raw material does not melt in the pneumatic feeder part. The pneumatic feeder part may comprise at least one additional cooling device (10), e.g. cooling water jacket, for cooling the plastic containing raw material in the pneumatic feeder part In the feeder of FIG. 1, the length of the pneumatic feeder part (1*b*) is 0.5-1 m. The screw (6) of the screw feeder part (1*a*) ends before the inlet of the steam (3). Thus, the end of the screw (6) is arranged 0.5-1.0 m from the wall of the gasifier (4). The steam acts as a pneumatic gas and the last 0.5-1.0 is fed pneumatically. The steam conveys the plastic containing waste into a fluidized bed (5) of the gasifier (4).

The steam (3) may be supplied via more than one inlet into the pneumatic feeder part (1*b*).

The process arrangement of FIG. 2 comprises a bubbling fluidized bed gasifier (4) in which the plastic containing waste (2) is gasified at low temperature, for example at 700-730° C., for forming a product (11). The process arrangement comprises the feeder (1) according to FIG. 1, in which the steam (3) is used as the pneumatic gas. The mixture of the plastic containing waste and steam is fed into a bubbling fluidized bed of the gasifier (4). The product which comprises, for example, ethylene and/or propylene is discharged from the gasifier. The product may be supplied to a desired process step or device for refining or upgrading the product.

The devices and equipments of the process used in these examples are known per se in the art, and therefore they are not described in any more detail in this context.

The feeder and method are suitable in different embodiments for feeding different plastic containing raw materials to desired processes. Further, the feeder and process arrangement are suitable in different embodiments for producing hydrocarbons from different plastic containing raw materials.

The invention is not limited merely to the examples referred to above; instead many variations are possible within the scope of the inventive idea defined by the claims.

The invention claimed is:

1. A feeder for feeding raw material which comprises plastic to a gasification or pyrolysis, wherein the feeder is integrated with a gasifier of the gasification or a pyrolysis reactor of the pyrolysis in which the gasification or the pyrolysis is carried out by steam and the plastic containing raw material is converted into products, and the feeder is arranged to feed the plastic containing raw material into a fluidized bed of the gasifier or pyrolysis reactor, the feeder comprises a screw feeder part and a pneumatic feeder part arranged after the screw feeder part, in which the screw feeder part and pneumatic feeder part form a combined feeder for feeding the plastic containing raw material which is in a solid form, the screw feeder part comprises at least a screw to transfer the plastic containing raw material to the pneumatic feeder part and at least one cooling device to cool the plastic containing raw material to below melting temperature in the screw feeder part, the pneumatic feeder part arranged after the screw feeder part, comprises at least one inlet to supply a pneumatic carrier material which is steam to the plastic containing raw material in the pneumatic feeder part for forming a mixture of the plastic containing raw material and the pneumatic carrier material, wherein a pressure of the steam in the feeder is 1-5 bar higher than a pressure in the gasifier or pyrolysis reactor, and the feeder comprises at least one gas lock to prevent a steam flow in the opposite direction.

2. The feeder according to claim 1, wherein the feeder comprises at least one gas lock provided with at least one rotary valve.

3. The feeder according to claim 1, wherein the cooling device is arranged to keep temperature in the screw feeder part below melting temperature of the plastic containing raw material.

4. The feeder according to claim 1, wherein the pneumatic feeder part comprises more than one inlet for supplying the pneumatic carrier material into the pneumatic feeder part.

5. The feeder according to claim 1, wherein a length of the pneumatic feeder part is 0.5-1 m.

6. A method for feeding raw material which comprises plastic to a gasification or pyrolysis, wherein the method comprises;

subjecting the plastic containing raw material which is in a solid form into a feeder which comprises a screw feeder part and a pneumatic feeder part, wherein the feeder is integrated with a gasifier of the gasification or a pyrolysis reactor of the pyrolysis in which the gasification or the pyrolysis is carried out by steam and the plastic containing raw material is converted into products, and arranging the feeder to feed the plastic containing raw material to the gasifier or pyrolysis reactor, transferring the plastic containing raw material by means of the screw feeder part which comprises at least a screw to the pneumatic feeder part arranged after the screw feeder part, and cooling the plastic containing raw material to below melting temperature in the screw feeder part, supplying a pneumatic carrier material which is steam to the plastic containing raw material via at least one inlet in the pneumatic feeder part for forming a mixture of the plastic containing raw material and the pneumatic carrier material, and feeding the mixture into a fluidized bed of the gasifier of the gasification or the pyrolysis reactor of the pyrolysis, wherein a pressure of the steam in the feeder is 1-5 bar higher than a pressure in the gasifier or pyrolysis reactor, and arranging at least one gas lock to the feeder to prevent a steam flow in the opposite direction.

7. The method according to claim 6, wherein the steam comprises a water vapour, and temperature of the steam is 130-190° C.

8. The method according to claim 6, wherein the plastic containing raw material comprises at least plastic containing waste.

9. The method according to claim 6, wherein the raw material is a heterogenous material comprising at least polyolefins.

10. The method according to claim 9, wherein the raw material further comprises PVC.

11. The method according to claim 6, wherein temperature is below 60° C. in the screw feeder part.

12. The method according to claim 6, wherein temperature is below 160° C. in the pneumatic feeder part, when steam is used as the pneumatic carrier material.

13. The method according to claim 6, wherein the plastic containing raw material is cooled in the screw feeder part to keep temperature below melting temperature of the plastic containing raw material.

* * * * *